US006894002B1

(12) United States Patent
Butters et al.

(10) Patent No.: US 6,894,002 B1
(45) Date of Patent: May 17, 2005

(54) RECEIVER MEDIUM FOR DIGITAL IMAGING

(75) Inventors: Alan Butters, Suffolk (GB); Andrew Clifton, Ipswich (GB)

(73) Assignee: Imperial Chemical Industries PLC, London (GB)

( * ) Notice: Subject to any disclaimer, the term of this patent is extended or adjusted under 35 U.S.C. 154(b) by 166 days.

(21) Appl. No.: 09/980,584

(22) PCT Filed: Jun. 5, 2000

(86) PCT No.: PCT/GB00/02163

§ 371 (c)(1),
(2), (4) Date: Mar. 26, 2002

(87) PCT Pub. No.: WO00/74944

PCT Pub. Date: Dec. 14, 2000

(30) Foreign Application Priority Data

Jun. 8, 1999 (GB) ..... 9913172

(51) Int. Cl.[7] ..... B41M 5/035; B41M 5/38
(52) U.S. Cl. ..... 503/227; 427/146; 428/32.8
(58) Field of Search ..... 8/471; 427/146; 503/227; 428/32.8, 32.51, 32.52

(56) References Cited

FOREIGN PATENT DOCUMENTS

EP 0 785 088 * 7/1997

WO wo 96/34766 * 11/1996

* cited by examiner

*Primary Examiner*—Bruce H Hess
(74) *Attorney, Agent, or Firm*—Pillsbury Winthrop LLP

(57) ABSTRACT

A receiver medium for digital imaging comprises a substrate having a dye-receiving surface bearing a coating comprising a highly branched functionalised polymer of generally globular form, e.g. a dendrimer, dispersed in a host polymer. Functional groups at or near the surface of the branched polymer, may interact with and bind dye molecules having complementary functional groups, eg dyes as disclosed in WO 96/34766, e.g. by acid-base interaction, thus having the effect of chemically fixing the dye within the coating on the receiver medium. Because dye molecules can be chemically bound to the branched polymer in the receiver sheet, it is possible to use host polymer materials of lower Tg than generally required in the prior art, with the host polymer typically having a Tg of less that 50° C. This means that dye molecules can have significantly increased diffusivity through the coating, prior to interaction, resulting in a more even distribution of dye through the coating than has been possible hitherto. The invention also covers a method of making the receiver medium, a method of printing, and a receiver medium/dye combination.

24 Claims, 4 Drawing Sheets

RECEIVER MEDIUM FOR DIGITAL IMAGING

This application is the U.S. National Phase of International Application PCT/GV00/02163 filed Jun. 5, 2000, which claims priority to Great Britain Patent Application 9913172.4, Jun. 8, 1999.

FIELD OF THE INVENTION

This invention relates to a receiver medium for use in digital imaging, and concerns a receiver medium for such use, a method of making such a medium, a method of printing using such a medium and a receiver medium/dye combination.

BACKGROUND TO THE INVENTION

Traditionally, photographs have been created by capturing a latent image on silver halide sensitised film, and then transforming the latent image into a colour reproduction of the original subject by a series of chemical processes. Overall the process is characterised by a continuous (analogue) relationship between an original image and the resulting print. Prints produced in this way have acceptable stability to various invasive agents such as fingergrease and also to fading by light.

In recent years the advent of digital cameras has allowed the capture of images in an electronic digital form, and their subsequent manipulation and printing without recourse to the use of silver films and associated chemical processing. This offers the possibility of substantial control over the whole process, which can now be performed in the home or office by a wide portion of the general population. It is predicted by some that digital imaging will in time substantially replace traditional photographic methods.

Printing processes used for digital imaging include thermal dye transfer printing and ink jet printing.

Thermal dye transfer printing is a generic term for processes in which one or more thermally transferable dyes arc caused to transfer from a dyesheet to a receiver in response to thermal stimuli. Using a dyesheet comprising a thin substrate supporting a dyecoat containing one or more such dyes uniformly spread over an entire printing area of the dyesheet, printing can be effected by heating selected discrete areas of the dyesheet while the dyecoat is pressed against a receiver sheet, thereby causing dye to transfer to corresponding areas of that receiver. The shape of the pattern transferred is determined by the number and location of the discrete areas which are subjected to heating. Full colour prints can be produced by printing with different coloured dyecoats sequentially in like manner, and the different coloured dyecoats are usually provided as discrete uniform print-size areas in a repeated sequence along the same ribbon-like dyesheet.

High resolution photograph-like prints can be produced by thermal dye transfer printing using appropriate printing equipment, such as a programmable thermal print head or laser printer, controlled by electronic signals derived from video, computer, electronic still camera, or similar signal generating apparatus. A typical high speed thermal print head has a row of individually operable tiny heaters spaced to print six or more pixels per millimetre, using very short hot pulses.

Receiver medium for thermal dye transfer printing generally comprises a substrate sheet supporting a receiver coat of a dye-receptive composition containing a material having an affinity for the dye molecules, and into which they can readily diffuse when an area of dyesheet pressed against it is heated during printing. Such receiver coats are typically around 2 to 6 $\mu$m thick, and materials with good dye-affinity are generally thermoplastic polymers, such as saturated polyesters, soluble in common solvents to enable them readily to be coated onto the substrate from solution.

In ink jet printing, a steam of charged ink droplets is projected onto ink receptive receiver medium at high velocity, eg up to 20 m/s. Movement of the ink jet may be computer controlled, and images may be formed and printed rapidly. By using inks of different colours a full colour image can be produced. In general, ink jet printing inks are water-based compositions that are usually dye-based solutions. Such inks are widely used in a range of ink jet printers, for commercial, office and domestic use including desk-top printers. A receiver medium for use in ink jet printing generally comprises a substrate carrying an ink absorbent layer that typically comprises a polymer or a mixture of polymers, eg cellulosic polymers such as carboxymethyl cellulose and especially hydroxyethyl cellulose; gelatins; vinyl polymers such as a polyvinyl alcohol and polyvinyl pyrrolidone; and acrylic polymers such as polyacrylic acid.

For convenience, dyes and inks for use in digital imaging techniques will be referred to generally as dyes.

Both the above printing methods suffer from the fact that the resulting images generally comprise dyes kinetically frozen in polymeric layers which are at a temperature below their Tg, ie the dye molecules are physically entrapped in the polymer in the form of a solid solution and are not chemically bound in position. Any changes resulting in the system being above the polymer Tg, eg due to thermal energy or ingress of swellants, plasticisers or contaminants such as fingergrease, are liable to result in dye migration which in turn can lead to dye crystallisation and loss of colour density or image blurring and loss of resolution.

It is also known in the art of digital imaging, and in particular thermal dye transfer printing and ink-jet imaging technologies, that dyes printed into low Tg polymeric receiver materials suffer image degradation as a result of dye migration over time. To overcome this, most current imaging systems employ receiver media with relatively high Tg polymers which are stable at room temperature, typically having a Tg of at least 60° C. High Tg receiver systems, however, typically suffer from low dye diffusion rates during the printing process, which in turn results in high dye concentrations near the surface of the image and subsequently poor image stability with respect to light and physical contact.

One approach to improving image stability in thermal dye transfer printing is to apply a polymeric protective layer either as a separate panel from a thermal transfer dyesheet, or in a separate lamination step. However, this approach can result in image blurring caused by thermal stimulation on application of the layer and also has the drawback of requiring extra material in the form of a separate panel or lamination sheet.

Another approach to improving image stability in thermal dye transfer printing is to arrange for the image dyes to be interactive with the receiver layer. For example, it has been proposed to render dyes immobile by the following methods:

1) Acid-base interactions. Here the dyes contain eg two or more acid groups that can form strong interactions with basic groups attached to the receiver polymer, eg as described in WO 96/34766.

2) Chelation. U.S. Pat. No. 5,512,531 of Konica discloses the interaction of dyes with metal ions in the receiver by a chelation process.

3) Cationic dyes. EP 506,034 of Sony describes the use of cationic dyes with receivers containing layered inorganic materials. These layered materials are capable of absorbing the charged cationic dyes, and holding them in a stable environment.

Finally, performance may be improved by reacting an appropriate dyestuff with the receiver layer, resulting in the formation of a covalent bond to attach the dye to the receiver.

It is a feature of all these interactive methods that insufficient heat is available to allow the dyes to migrate sufficiently to permit the development of the full interaction, and hence to realise the full potential stability of the system. Indeed stratification of the dye at the surface (ie concentration of dye at the surface of the receiver medium) is a particular problem with these systems. The significance of this problem has led to proposals to use acid vapour treatment to fix an image (U.S. Pat. No. 4,880,769), and to use low Tg receiver polymers containing organic acid groups or low Tg receivers containing oligomeric and polymeric acids to reprotonate deprotonated cationic dyes (U.S. Pat. No. 5,627,956).

SUMMARY OF THE INVENTION

In one aspect the present invention provides a receiver medium for digital imaging, comprising a substrate having a dye-receiving surface bearing a coating comprising a highly branched functionalised polymer of generally globular form dispersed in a host polymer.

The extent of branching of a polymer can be defined in terms of the degree of branching, ie the proportion of monomer units carrying a branch. A polymer that is fully branched, that is in which each monomer unit carries a branch, thus has a degree of branching of 1, while a linear, non-branched polymer has a degree of branching of 0. The term "highly branched polymer" is used herein to mean a polymer having a degree of branching of at least 0.5. Such polymers are sometimes also referred to as hyperbranched polymers. The growth pattern of branching may be regular or irregular. Polymers with a degree of branching of 1 (perfect branching) and a regular growth pattern are known as dendrimers. FIG. 1 is a representation of a dendrimer, having a degree of branching of 1 and a regular growth pattern, and FIG. 2 is a representation of a polymer with a degree of branching of 1 and an irregular growth pattern, both having a tree-like form. It is thus possible, but not essential, for the highly branched polymer to be a dendrimer.

The degree of branching itself is not determinative of the three dimensional shape or form of the polymer. The branched polymers useful in the invention, as well as being highly branched, must be of generally globular form. The term "generally globular form" means non-linear and non-planar in form, having significant extent in all directions and preferably having generally similar dimensions in all directions, ie being generally spherical in form. The ratio of the maximum dimension:minimum dimension of the branched polymer is preferably $\leqq 4:1$, more preferably $\leqq 3:1$. Dendrimers and similar structures with irregular or regular growth patterns (eg as shown in FIGS. 1 and 2) are of generally globular form, as branching and growth occurs outwardly in three dimensions, as are polymers of similar form but with a lesser degree of branching, and so are all suitable for use in the present invention. Also suitable are so-called star polymers, which comprise a central core from which a number of branched polymer strands (of the same or different molecular structure) radiate outwardly.

Highly branched polymers of generally globular form, eg dendrimers, have a large number of terminal or end groups per unit molecular weight, typically concentrated at or near the surface of the molecule. The highly branched polymer is functionalised, that is, at least some of the end groups carry functional groups eg selected from: OH, $NH_2$, NHR, $NR_2$, COOH, $CONH_2$, NHCOR, CONHR, $SO_2NH_2$, $SO_2NHR$, $SO_3H$, $NHCONH_2$, NHCONHR,=NOH and $PO_3H$, in which R is selected from CH, $NO_2$, Cl, F, Br, $C_{1-6}$alkyl, $C_{1-6}$alkoxy, $NHCOC_{1-6}$alkyl, NHCOphenyl, $NHSO_2$alkyl, $NHSO_2$phenyl and aryloxy, more preferably from the groups having at least one H atom. Such functional groups at or near the surface of the branched polymer may interact with and bind dye molecules having complementary functional groups, eg dyes as disclosed in WO 96/34766, eg by acid-base reaction, thus having the effect of chemically fixing the dye within the coating on the receiver medium. Such functional groups on the polymer may optionally additionally or alternatively form cross-links with the host polymer. Further, by appropriate molecular design and synthesis and selection of appropriate functional groups it is possible to construct branched polymeric materials with either a hydrophilic surface, eg by use of primary amine functional groups, or a hydrophobic surface, eg by use of functional groups such as alkyl chains. The ability to vary the hydrophobicity of the polymer surface provides the capability of producing polymers with optimum solubility characteristics within the host polymer. The functional groups are thus selected with regard to factors including the nature of the host polymer, and the type of dyes with which the receiver medium is intended for use.

In general, the greater the extent of functionalisation of the highly branched polymer the better. Preferably at least 50%, more preferably at least 70%, of the end groups carry functional groups as discussed above, with the functional groups preferably being at or near the surface of the highly branched polymer so as to be accessible to dye molecules.

The chemistry of the remainder of the highly branched polymer is generally unimportant The highly branched polymer typically has a molecular weight of at least 1000.

The radius of gyration of the highly branched polymer in a suitable good solvent is preferably in the range 2 to 10 nm.

Highly branched polymers of generally globular form, eg dendrimers, have low viscosity relative to their molecular weight compared with linear polymers. The reduced viscosity has benefits for processing and handling of the polymers in terms of case of use, incorporation in liquid coatings etc, and also means it is possible to use polymers of higher molecular weight than would otherwise be the case. The reduced viscosity also allows solutions with very high solids content to be used as coatings.

Suitable highly branched polymers, eg dendrimers, may be synthesised using known techniques and are available commercially ee from Aldrich.

The advantage of such highly branched polymers over crosslinked polymer particles is that they present very large surface areas for interaction with dye molecules, are readily soluble in coating solvents and do not present significant light scattering or other optical defects by virtue of their being molecular in nature.

The host polymer is selected having regard to the digital imaging technique for which the receiver medium is intended for use, ie thermal dye transfer printing or ink jet printing. Suitable polymers are well known to those skilled in the art. For thermal dye transfer printing, polymers such as polyesters, poly(vinyl pyridine), vinyl pyrrolidone/vinyl acetate, vinyl chloride/vinyl acetate copolymers, cellulosic materials, polycarbonate etc may be used; while for ink jet printing, polymers such as vinyl polymers, acrylic polymers and cellulosic polymers such as carboxymethyl cellulose and hydroxyethyl cellulose may be used. The host polymer may be crosslinked in a known manner. The host polymer is preferably relatively inert and unreactive with respect to the dye molecules with which the medium is intended for use, with the host polymer having no or only a few groups capable of interacting strongly with the dye. Thus the host polymer should have low affinity for the dye compared with the affinity of the dye for the highly branched polymer, with the dye being freely soluble in the host polymer, so that the dye is able to move freely through the host polymer and thus reach and interact with the highly branched polymer. Suitable mixtures or host polymers may be used. Host polymers are generally linear (non-branched).

Because the invention enables dye molecules to be chemically bound to the branched polymer in the receiver sheet, it is possible to use host polymer materials of lower Tg than are generally required in the prior art. This means that dye molecules can have a significantly increased diffusivity through the coating, prior to interaction, resulting in a more even distribution of dye through the coating than has been possible hitherto, particularly avoiding high dye concentrations at or near the coating surface.

The host polymer thus preferably has a Tg<50° C., and more preferably <25° C. Good results have been obtained using the polyester Vylon 103 (Vylon is a Trade Mark) from Toyobo, which has a Tg of 47° C. as the host polymer in a receiver medium for use in thermal dye transfer printing. Vylon 103 has good compatibility with a wide range of dyes.

Certain commercially available highly branched polymer products as supplied include an amount of generally linear, non-highly branched polymer, and it is possible that this non-highly branched content of the highly-branched product may function as the host polymer.

The highly branched polymer is suitably present in an amount in the range 10 to 90%, preferably 20 to 60% by weight of the coating.

The highly branched polymer is dispersed throughout the host polymer and functions as a molecular heterophase, presenting a very large surface area within the host polymer. By dispersed is meant a system which either shows no large scale heterogeneity (ie>1$\mu$m), or else if heterogeneity does exist the refractive indeces of the two polymers are suitably matched. The highly branched polymer is substantially immobile within the host polymer at room temperature due to its large molecular size. Immobility can be enhanced, if required, by low level cross-linking of surface functional groups of the highly branched polymer with the host polymer, eg using epoxides or melamine chemistry, to form an interpenetrating network with the host polymer.

The substrate is typically in the form of a film or sheet of suitable material. Typical substrate material include polymeric materials having suitable properties including dimensional stability, optical transparency, translucency or opacity, tensile strength, adhesion characteristics, thermal stability, hardness etc for the intended purpose. Transparent polymeric substrate materials suitable for use in the production of transparencies include sheets or films of polyester eg poly(ethyleneterephthalate) (PET) such as Melinex (Melinex is a Trade Mark) or poly(ethylenenaphthalate) (PEN). Polycarbonate sheets may also be used for this purpose. Such transparent sheets typically have a thickness in the range about 50 $\mu$m to about 150 $\mu$m. Other possible polymeric materials include polysulphones, polyvinyl chloride, polystyrene, polyimides, polyolefins, polymethyl methacrylate, cellulose esters such as cellulose acetate etc. A wide range of paper, card and laminated materials may also be used as the substrate.

To promote adhesion of the ink absorbent layer to a polymeric substrate, it is often desirable first to treat a surface of the substrate with a priming medium. Creation of a priming layer is conveniently effected by eating a surface of a polymeric substrate with an agent known in the art to have a solvent or swelling action on the substrate polymer. Examples of such conventional agents, which are particularly suitable for the treatment of a polyester substrate, include a halogenated phenol dissolved in a common organic solvent e.g. a solution of p-chloro-m-cresol, 2,4-dichlorophenol, 2,4,5- or 2,4,6-trichlorophenol or 4-chlororesorcinol in acetone or methanol. In addition, and preferably, the priming medium may contain a partially hydrolysed vinyl chloride vinyl acetone copolymer. Such a copolymer conveniently contains from 60 to 98% of vinyl chloride, and from 0.5 to 3% of hydroxyl units, by weight of the copolymer. The molecular weight (number average) of the copolymer is conveniently in a range of from 10,000 to 30,000, and preferably from 16,500 to 25,000. Desirably the priming layer comprises a polyester material.

If desired, a plurality of priming layers may be sequentially applied to the substrate of receiver medium according to the present invention.

The priming medium is suitably applied at a concentration level which will yield a priming layer having a relatively thin dry coat thickness, for example generally less than 2 $\mu$m, and preferably less than 1 $\mu$m.

The coating is conveniently formed by mixing the coating materials with a suitable solvent or solvent mixture, as is known in the art. The coating materials may be applied by any suitable coating technique, including those known in the field, eg by use of a Meier bar, by roller coating, rod coating, slide coating, curtain coating, doctor coating etc. The coating may then be dried in a known manner.

The coating may be applied to the entire surface of the substrate or to only selected areas of the substrate surface. In the case of a sheet or film of substrate, the coating will typically be applied to at least one surface and possibly both surfaces (to enable double-sided printing).

Drying of the coating may be effected by conventional drying techniques, for example by suspending the coated substrate in a hot air oven maintained at an appropriate temperature. A drying temperature of about 130° C. is usually suitable for a polyester substrate. The thickness of the coating when dry may vary over a wide range, but is conveniently in the range 1 $\mu$m to 100 $\mu$m, preferably 50 $\mu$m or less, especially in the range from 2 $\mu$m to 10 $\mu$m, for media for use in thermal dye transfer printing and in the range 10 $\mu$m to 50 $\mu$m for media for use in ink jet printing.

The coating desirably includes particulate filler material, to modify the mechanical properties of the coating and also (for media for use in ink jet printing) to modify the porosity of the coating. Suitable materials for this purpose include inorganic, organic or polymeric particulates such as silica including amorphous silica, crystalline silica, fumed silica, alumina, aluminium trihydrate, calcium carbonate, glass, clays, aluminium silicates, pi polyolefin particulates, organic pigments and mixtures thereof. Particulate filler material has a tendency to increase light scattering, reducing coating transparency, so this factor must be taken into consideration in relation to transparent substrates and coatings, while being of less relevance to opaque receiver media The particulate filler material may additionally act to increase surface roughness of the coating, thus reducing the tendency of the coating to block, ie stick by wetting action to adjacent surfaces. Filler material particles suitably have a primary size in the range 5 $\mu$m to 50 $\mu$m. Fillers with a dimension much smaller than, the wavelength of light can be used at higher loadings than larger fillers (because of their lower scattering) and therefore make a greater contribution to the mechanical properties of the coating, but are less efficiently at creating surface roughness than are fillers with a major dimension of comparable size to the coating thickness. It is often desirable to incorporate fillers of two different sizes in order to optimise the overall properties of the coating.

The receiver medium may include an optional top coat (or supercoat) over the coating, as is known in the art.

The receiver medium may optionally include one or more back coats on the side of the substrate remote from the dye-receiving surface. These are generally based on a cross-linked polymer binder, and are provided to fulfil a number of different roles, including providing increased friction to improve printer feed, providing antistatic properties and preventing transfer of dyes from one receiver sheet to another.

Other additives may optionally be included in the coating to improve properties of the coating. For example, anti-static materials may be included. As a further possibility lubricants and release agents, such as waxes and silicones, may be included in media for use in thermal dye transfer printing to reduce friction and/or adhesion at the coating surface.

In a further aspect, the invention provides a method of making a receiver medium, comprising applying to a dye-receiving surface of a substrate a coating comprising a highly branched functionalised polymer of generally globular form dispersed in a host polymer.

The receiver medium is typically used for digital imaging, eg by ink jet printing or thermal dye transfer printing, in known manner.

In another aspect, the invention thus provides a method of printing, comprising applying dye to the dye-receiving surface of receiver medium in accordance with the invention by a digital imaging technique.

A further aspect of the invention provides a digital imaging receiver medium/dye combination in which the receiver medium comprises a substrate having a dye-receiving surface bearing a coating comprising a highly branched functionalised polymer of generally globular form dispersed in a host polymer, and the dye is capable of interacting with the highly branched polymer.

In use of a receiver medium in accordance with the invention, in preferred embodiments at least, dye molecules are able to move freely through the host polymer, resulting in good penetration and distribution of dye throughout the coating. The dye molecules interact with the highly branched polymer that is dispersed throughout the coating, and become fixed in position with good distribution throughout the coating, ie without undesirable concentration at the surface. By suitable adjustment of the coating it may be possible to arrange for some degree of stratification of the dye, with slightly higher concentrations of dye being bound slightly away from the coating surface where the dye is less vulnerable to fading, abrasion etc, without being concentrated too far from the coating surfaces which would result in poor image quality.

The invention will be further described, by way of illustration, in the following Examples, and with reference to the accompanying drawings, in which.

Figure 1:
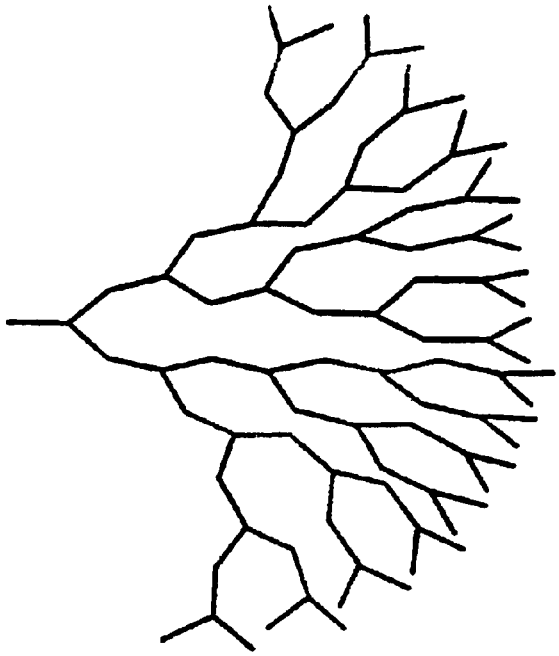
FIG. 1 is a schematic representation of a dendritic polymer, having perfect branching and a regular growth pattern.
Figure 2:
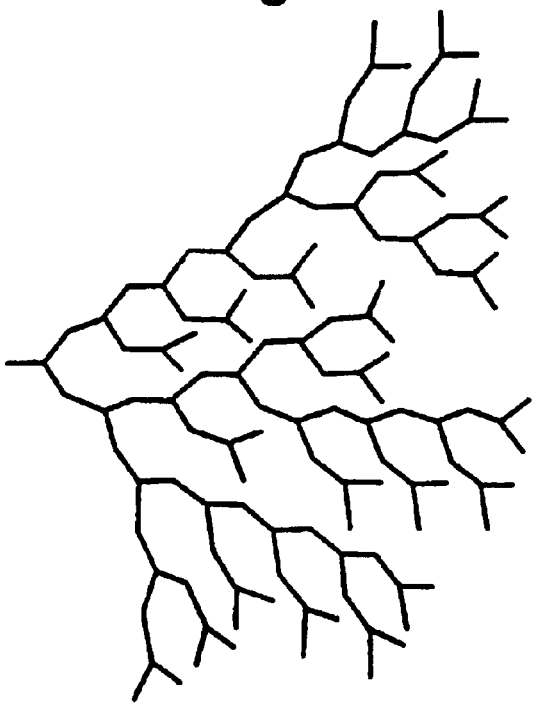
FIG. 2 is a schematic representation of a hyperbranched polymer, having perfect branching and an irregular growth pattern.
Figure 3:
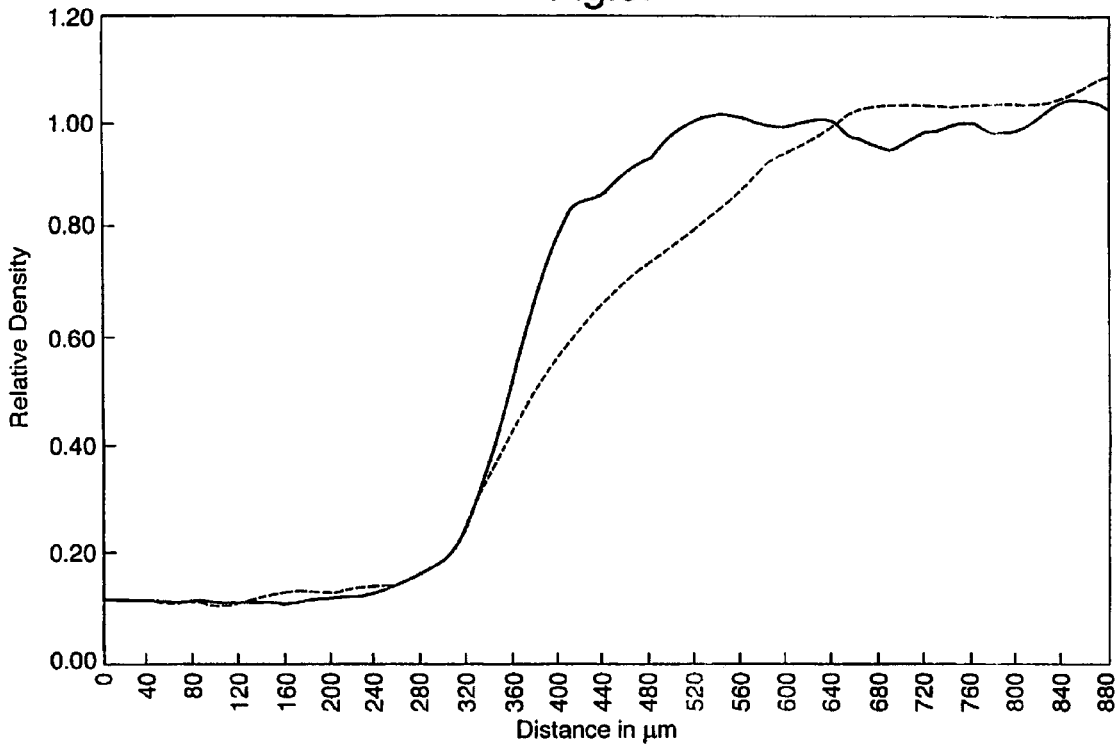
FIG. 3 is a graph of relative density versus distance (in $\mu$m) showing density profiles, before (full line) and after (dashed line) exposure to tetrahydrofuran (THF) vapour, across a printed edge of an acid functional dye printed onto a receiver medium comprising Vylon 103.
Figure 4:
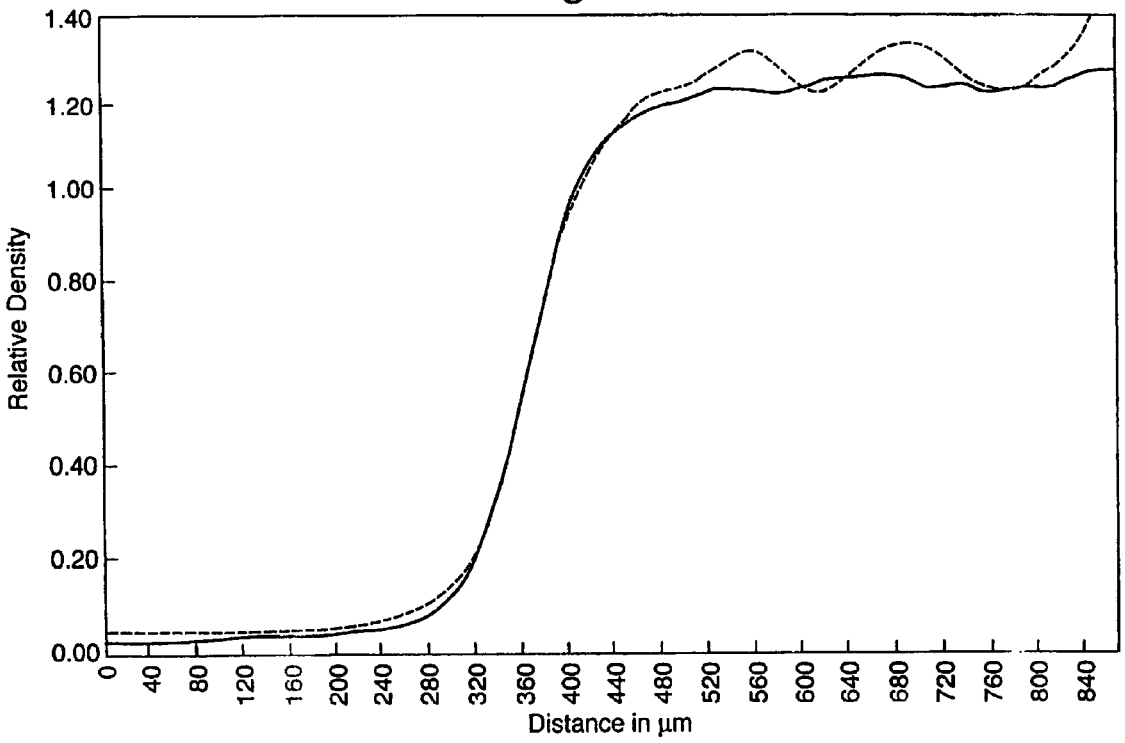
Figure 5:
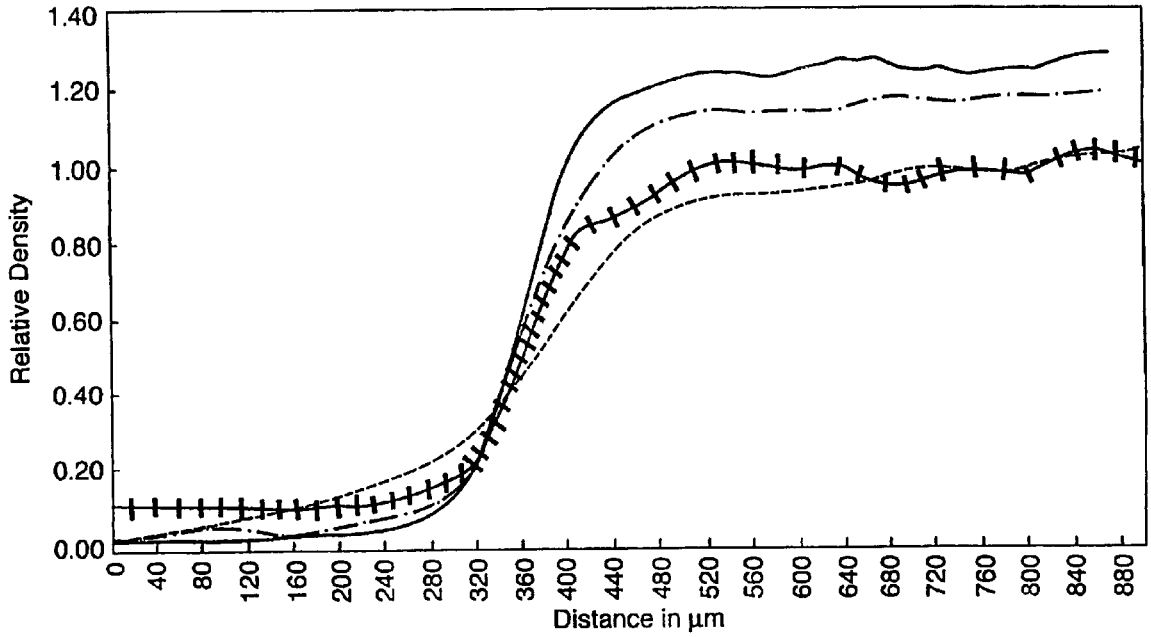

FIG. 4 is a graph similar to FIG. 3 showing results using a receiver medium comprising Vylon 103 and containing 25% by weight dendrimer, and FIG. 5 is a graph similar to FIG. 3 showing results for similar receiver media, with and without dendrimer, before and after heating to, 75° C. for 45 days, with results for medium without dendrimer before heating shown by hatched line and after heating shown by dashed line, and results for medium with dendrimer before heating shown by full line and after heating shown by dot dash line.

EXAMPLE

The following formulation was prepared and coated onto a synthetic laminate paper substrate using a K5 Meier coating bar to give a wet coated film approximately 36 $\mu$m thick. The substrate comprises a cellulose core, voided polypropylene layers and a whitening layer on the front surface. The film was then dried by air and cured at 110° C. for 90 seconds.

| | |
|---|---|
| Starburst dendrimer, generation 2 (20% solids in methanol), supplied by Aldrich | 1.25 g |
| Vylon 103 polyester, supplied by Toyobo | 0.75 g |
| Toluene (solvent) | 3.36 g |
| Methyl ethyl ketone (solvent) | 5.02 g |
| Beetle 692 (melamine crosslinker (for Vylon and Tegomer), 50% solids), supplied by BIP | 0.004 g |
| PK3 (di-N-butylamine blocked para toluene sulfonic acid) 28% solids in methanol | 0.004 g |
| Tegomer 2311 (Hydroxy functional siloxane (to impart release properties)), supplied by T.H. Goldscmidt | 0.002 g |

The Starburst dendrimer has a molecular weight (Mn) of 3256 and has the following formula:

$$[\text{-}CH_2N[CH_2CH_2CONHCH_2CH_2N[CH_2CH_2CONHCH_2CH_2N(CH_2CH_2CONHCH_2CH_2NH_2)_2]_2]_2]_2.$$

Starburst dendrimer has 16 primary amino surface functional groups.

The dried film was then printed with a dyesheet bearing an acid functional dye (known as S167434) using a thermal dye transfer printer. The dye S167434 has the following structure:

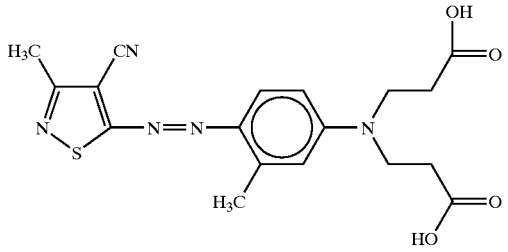

The acid functional dyesheet was prepared by coating with a K3 Meier bar a 4.2 wt % solution in THF (1:2 dye to poly(vinyl butyral) (supplied by Sekisui) binder ratio) onto 6 μm polyester film supplied by Diafoil (Diafoil is a Trade Mark) precoated with a heat resistant co back coat. The coated dyesheet was dried at 110° C. for 30 seconds. For reference, a comparative receiver film comprising Vylon 103 at the same percentage solids of resin was prepared and printed in the same way.

The edge profiles of the printed films were then examined, perpendicular to the print head alignment, using a Sahara PDM5 scanning microdensitometer, manufactured by Konishiroku, in reflection mode. Two experiments were then performed on separate samples, the first where the samples were exposed to THF vapour for 120 minutes and the second where the samples were heated at 75° C. for 45 days. After each period the edge profiles were re-recorded and the results are shown in FIGS. 3 to 5. The dye is very soluble in THF, and THF has the effect of swelling the coating.

FIG. 3 show results using a receiver medium comprising Vylon 103 without dendrimer and demonstrates that after 120 minutes exposure to THF vapour diffusion has clearly taken place. In contrast, FIG. 4 shows that with receiver medium in accordance with the invention, including dendrimer, no diffusion has taken place after 120 minutes exposure to THF.

FIG. 5 shows results for Vylon 103 receiver medium, with and without dendrimer, before and after heating at 75° C. for 45 days. Diffusion is clearly less in samples including dendrimer.

What is claimed is:

1. A receiver medium for digital imaging, comprising a substrate having a dye-receiving surface bearing a coating comprising a highly branched functionalised polymer of generally globular form dispersed in a host polymer, wherein the host polymer has a Tg of <50° C.

2. A receiver medium according to claim 1, wherein at least some of the end groups of the highly branched polymer carry functional groups selected from OH, $NH_2$, NHR, $NR_2$, COOH, $CONH_2$, NHCOR, CONHR, $SO_2NH_2$, $SO_2NHR$, $SO_3H$, $NHCONH_2$, NHCONHR, =NOH and $PO_3H$, in which R is selected from CH, $NO_2$, Cl, F, Br, $C_{1-6}$alkyl, $C_{1-6}$alkoxy, $NHCOC_{1-6}$alkyl, NHCOphenyl, $NHSO_2$alkyl, $NHSO_2$phenyl and aryloxy.

3. A receiver medium according to claim 2, wherein at least some of the end groups of the highly branched polymer carry functional groups having at least one H atom.

4. A receiver medium according to claim 1, 2, or 3, wherein at least 50% of the end groups of the highly branched polymer carry functional groups.

5. A receiver medium according to claim 1, wherein the highly branched polymer has a molecular weight of at least 1000.

6. A receiver medium according to claim 1, wherein the radius of gyration of the highly branched polymer is in the range 2 nm to 10 nm.

7. A receiver medium according to claim 1, wherein the host polymer is selected from polymers including polyesters, acrylic polymers, vinyl polymers, poly(vinyl pyridine), vinyl pyrrolidone/vinyl acetate, vinyl chloride/vinyl acetate copolymers, and cellulosic polymers.

8. A receiver medium according to claim 1, wherein the highly branched polymer is present in an amount in the range 10% to 90% by weight of the coating.

9. A receiver medium according to claim 1, wherein the substrate is in the form of a film or sheet of material.

10. A receiver medium according to claim 1, wherein the substrate is pre-treated prior to application of the coating.

11. A receiver medium according to claim 1, wherein the coating has a thickness in the range 1 μm to 100 μm for media for use thermal dye transfer printing and in the range 10 μm to 50 μm for media for use in ink jet printing.

12. A receiver medium according to claim 1, wherein the coating includes particulate filler material.

13. A receiver medium according to claim 1, including a top coat over the coating.

14. A receiver medium according to claim 1, including one or more back coats on the side of the substrate remote from the dye-receiving surface.

15. A receiver medium according to claim 14, wherein the coating has a thickness of 50 μm or less for media for use in thermal dye transfer printing.

16. A receiver medium according to claim 14, wherein the coating has a thickness in the range from 2 μm to 10 μm for media for use in thermal dye transfer printing.

17. A receiver medium according to claim 1, wherein at least 70% of the end groups of the highly branched polymer carry functional groups.

18. A receiver medium according to claim 1, wherein the highly branched polymer is present in an amount in the range 20% to 60% by weight of the coating.

19. A method of making a receiver medium, comprising applying to a dye-receiving surface of a substrate a coating comprising a highly branched functionalised polymer of generally globular form dispersed in a host polymer, wherein the host polymer has a Tg <50° C.

20. A method of printing, comprising applying dye to the dye-receiving surface of receiver medium in accordance with claim 1 by a digital imaging technique.

21. A digital imaging receiver medium/dye combination in which the receiver medium comprises a substrate having a dye-receiving surface bearing a coating comprising a highly branched functionalised polymer of generally globular form dispersed in a host polymer having a Tg <50° C., and the dye is capable of interacting with the highly branched polymer.

22. A combination according to claim 21, wherein the receiver medium comprising a substrate having a dye-receiving surface bearing a coating comprising a highly branched functionalised polymer of generally globular form dispersed in a host polymer, wherein the host polymer has a Tg of <50° C. and wherein at least some of the end groups of the highly branched polymer carry functional groups selected from OH, $NH_2$, NHR, $NR_2$, COOH, $CONH_2$, NHCOR, CONHR, $SO_2NH_2$, $SO_2NHR$, $SO_3H$, $NHCONH_2$, NHCONHR, =NOH and $PO_3H$, in which R is selected from CH, $NO_2$, Cl, F, Br, $C_{1-6}$alkyl, $C_{1-6}$alkoxy, $NHCOC_{1-6}$alkyl, NHCOphenyl, $NHSO_2$alkyl, $NHSO_2$phenyl and aryloxy.

23. A combination according to claim 21, wherein the dye has functional groups complementary to functional groups of the highly branched polymer.

24. A combination according to claim 21, wherein the highly branched polymer and dye are capable of interacting by acid-base reaction.

* * * * *